United States Patent [19]

Field

[11] Patent Number: 4,594,802

[45] Date of Patent: Jun. 17, 1986

[54] DISPLAY DEVICE

[76] Inventor: Frank P. Field, 854 Napoli Dr., Pacific Palisades, Calif. 90272

[21] Appl. No.: 599,195

[22] Filed: Apr. 11, 1984

[51] Int. Cl.[4] ..... G09F 3/18

[52] U.S. Cl. ..... 40/10 D; 40/152.1

[58] Field of Search ..... 40/10 D, 152.1, 156, 40/158 R, 611, 152

[56] References Cited

U.S. PATENT DOCUMENTS

| | | | |
|---|---|---|---|
| 560,080 | 5/1896 | Booker | 40/10 D |
| 1,465,244 | 8/1923 | Hager | 40/10 D |
| 2,540,221 | 2/1951 | Ten Hoeve et al. | 40/10 D |
| 2,874,498 | 2/1959 | Butkevich | 40/152 |
| 3,820,262 | 6/1974 | Dewsnap | 40/10 D |
| 4,144,664 | 3/1979 | De Korte | 40/10 D |
| 4,165,572 | 8/1979 | Sussman | 40/10 D |

FOREIGN PATENT DOCUMENTS

| | | | |
|---|---|---|---|
| 859451 | 1/1961 | United Kingdom | 40/152 |

*Primary Examiner*—Robert P. Swiatek
*Assistant Examiner*—Cary E. Stone

[57] ABSTRACT

A display device uses a generally transparent cardholder member that is detachably mounted to a base member. The cardholder member is formed of a pair of plates maintained in a spaced coplanar orientation by plural pin and hole assemblies. A ledge is provided adjacent the lower edge of each of the plates adapted to support a display card thereon while the plural pin and hole assemblies additionally provide an auxiliary support surface adapted to mount supplemental header cards.

7 Claims, 11 Drawing Figures

SUPER VALUE

1/2 OFF SALE
$10 50
$21.00
MEN'S SHIRTS

1/2 OFF SALE
$10 50
MEN'S SHIRTS

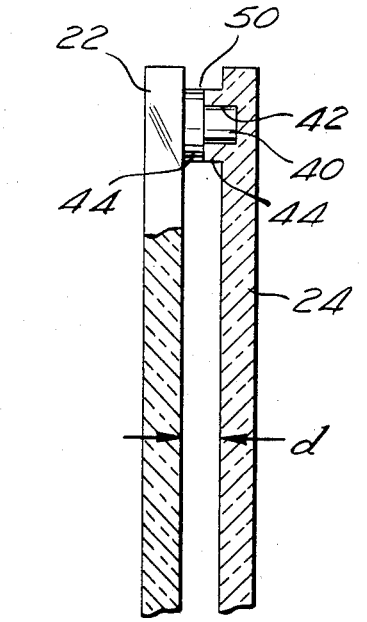
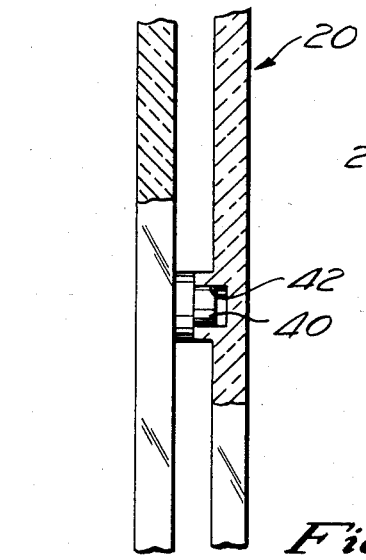
Fig. 10
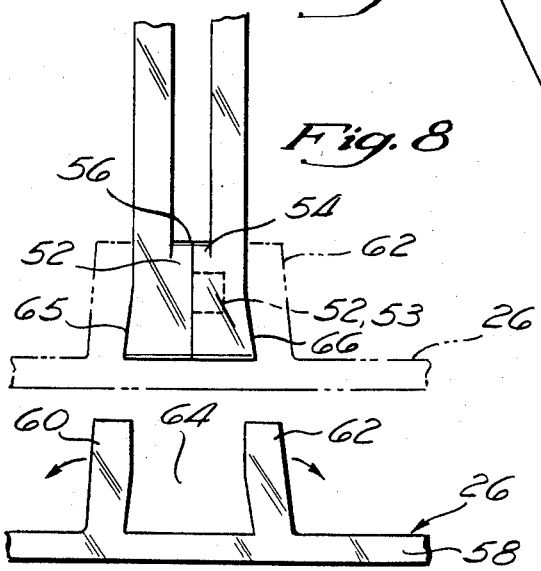
Fig. 8
Fig. 9
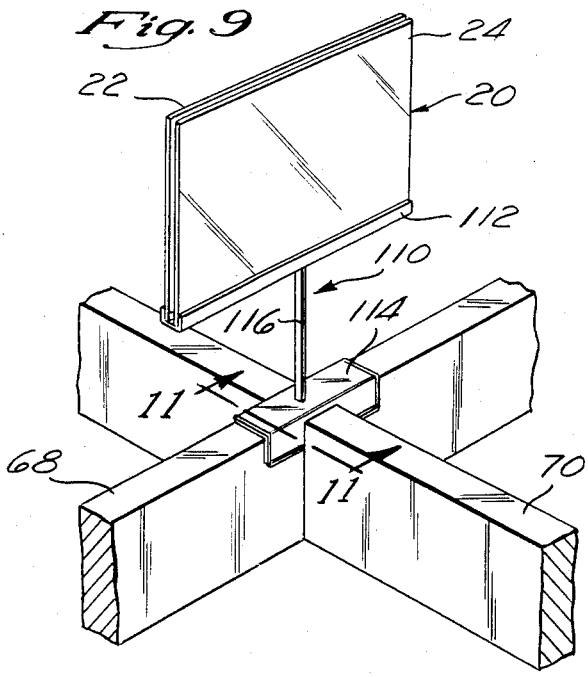
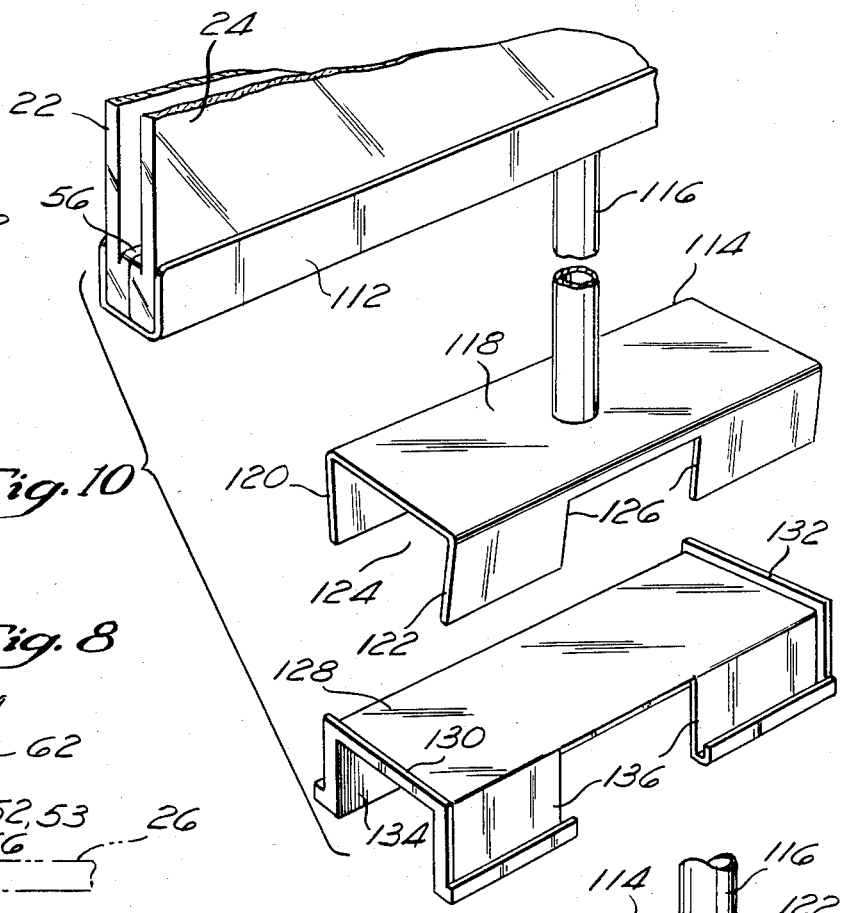
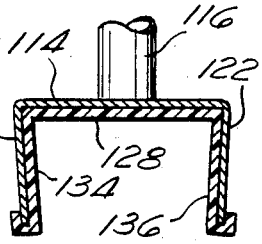
Fig. 11

DISPLAY DEVICE

BACKGROUND OF THE INVENTION

This inventin relates to a device to be used to display advertisements of goods or services offered to a consumer. More particularly, the invention relates to a transparent card holder and stand which can be used to present advertising or informative messages on display counters or tables.

A variety of methods and devices have been utilized to inform consumers of product prices, characteristics, or special sales or features of merchandise in conjunction with the display of the goods. In instances where it is inappropriate to mark the good directly or when it is desirous to display supplemental announcements in conjunction with the goods, a particular method has been devised which utilizes a transparent cardholder that is self-supporting and generally placed in close proximity to the goods. A typical example of such a device is a clear plastic sheet into which a U-shaped fold has been formed in the center. In use, the inverted U-shaped fold opens downwardly with the flat ends of the sheet being adapted to lie on a surface to serve as support for the device. Cards are then placed into the fold from the side or bottom and are supported by the counter surface. Although the device has proven useful in many applications, there are inherent difficulties in its use.

Since these display devices are frequently moved, the card, which normally rests on the support surface, often falls from the display device when it is moved. Also because of the heat-forming method of creating the fold, the distance between the surfaces of the fold typically cannot be precisely controlled, often resulting in difficulty in placing and removing the cards from the device.

Also, in many instances, it is desirable to place additional information in the device without removing the original advertisement, for example, information concerning special sale prices. In the conventional prior art, the additional information, referred to as a "header card" would necessarily obscure the original advertisement. Further, since the fold-over device is normally constructed from a single piece of material, the stand or base portion is an integral part of the device and require a flat surface on which to rest. This construction both restricts the surface on which the card holder may be placed and necessitates the advertisement being displayed at the surface level.

For these and other reasons, there exists a need for a card display device that is easy to use, supports the advertisement without relying on the supporting surface, provides for easy placement and removal of the cards, accommodates additional information such as a header card without obscuring the original advertisement, and provides for interchangeable bases which permits use on a variety of surfaces.

SUMMARY OF THE INVENTION

The display device of the present invention provides a significantly improved device for displaying advertisements for goods or services which eliminates the deficiencies of the prior art, in particular, the fold-over card holder.

More particularly, the present invention comprises an improved display device consisting generally of a transparent cardholder that is detachably mounted to a base.

The cardholder includes a pair of separable transparent plates of semi-rigid material and having a constant distance between the plates. Small ledges are formed along the bottom of the plates which provide a continuous support surface for the display placed in the device. The construction which provides for a constant distance between the plates allows cards to be placed in the cardholder from the top thereby eliminating the difficulty of placing cards from the side or the bottom, and also eliminating the problems of cards falling out of the cardholder unexpectedly.

A series of aligned and complimentary shaped pin and hole structures are formed about the periphery of each sheet on the inside surfaces that serve to snap-fit the two sheets together during assembly. Each pin and hole is additionally surrounded by a raised boss extending outwardly from the inside surface of the sheet. The bosses are sized to result in a predetermined and constant spacing of the plate becoming juxtaposed upon assembly, therefore providing for easy placement of the cards from the top and easy removal of the cards by inverting the display device, eliminating the inadvertent binding of the cards within the cardholder.

Additionally, the pin and hole assemblies that may be located along the sides of the cardholder serve to restrict any lateral movement of the card within the cardholder. Also, the pin and hole assemblies are strategically placed in the upper corners of the cardholder and serve as an auxiliary support surface adapted to support supplemental header cards. To advantageously use these pin and hole assemblies for support, header cards are designed with a special "tongue" or extension that is placed behind the advertisement card, the remainder of the header card containing the information to be displayed is longer than the distance between the two pin and hole assemblies in the upper corners, thereby allowing the header card to rest on the pin and hole assemblies for support. In this way, special header cards can be easily placed and removed from the display device without obscuring the original advertisement or requiring any additional modifications to the cardholder.

The base of the present invention is comprised of an elongate channel into which the cardholder is placed, and a lower portion that is used to support the cardholder on a particular surface. The channel portion is sufficiently long to engage a substantial portion of the cardholder and is essentially the same width as the combined width of the pair of transparent plates including the bottom ledge. Additionally, the channel is formed in a trapezoidal shape, to accommodate the complimentary formed cross-sectional shape of the bottom of the transparent plates. This construction provides for a secure interlocking assembly between the cardholder and the base, and permits interchanging different cardholders and bases. Although the base portion may be designed to adapt to a variety of particular surfaces, the invention contemplates two general designs. The first design includes a flat sheet of semi-rigid material upon which the channel is permanently affixed and is adapted to rest on a conventional flat surface. The cardholder is placed in the base portion by flexing the base portion in a generally convex manner which widens the channel, placing the bottom of the cardholder in the channel, then releasing the tension on the base which causes the base spring back to its initial configuration and firmly engage the bottom of the cardholder. The second general design of the base includes a lower base member formed to rest on an upright of a tandem display structure, the channel being attached to the lower base member by a cylindrical post of variable length which permits the cardholder to be displayed at various distances above the surface.

As such, the present invention alleviates many of the deficiencies of the prior art by providing a cardholder into which cards may be easily placed and removed from the top, and which provides self-support of the cards. Additionally, the design of the present invention prvides for support for header cards without obscurring the original card in the cardholder and does not require additional modifications to the device. Further, because the cardholder and the base are easily separated, a variety of different size cardholders and base designs can be interchangeably used. This separates construction also permits the economical replacement of damaged parts. In addition, the pin and hole assembly with their associated raised boss design, provides a snap fit design with a constant separation between the plates which may be varied to adapt for use with cards having abnormal thicknesses.

DESCRIPTION OF THE DRAWINGS

These as well as other features of the present invention will become more apparent upon reference to the drawings, wherein:

FIG. 8 is a partial cross-sectional view taken about lines 8—8 of FIG. 2;

FIG. 9 is a perspective view illustrating a second embodiment of a base structure that may be used to position the display device on intersecting upright members;

FIG. 10 is an exploded partial perspective view of the second embodiment of the base and a protective insert for the base; and FIG. 11 is a cross-sectional view showing a portion of the base of FIG. 10 with the protective insert in place.

DETAILED DESCRIPTION OF THE PREFERRED EMBODIMENT

Figures 1, 2, 3, 4, 5, 6, 7:
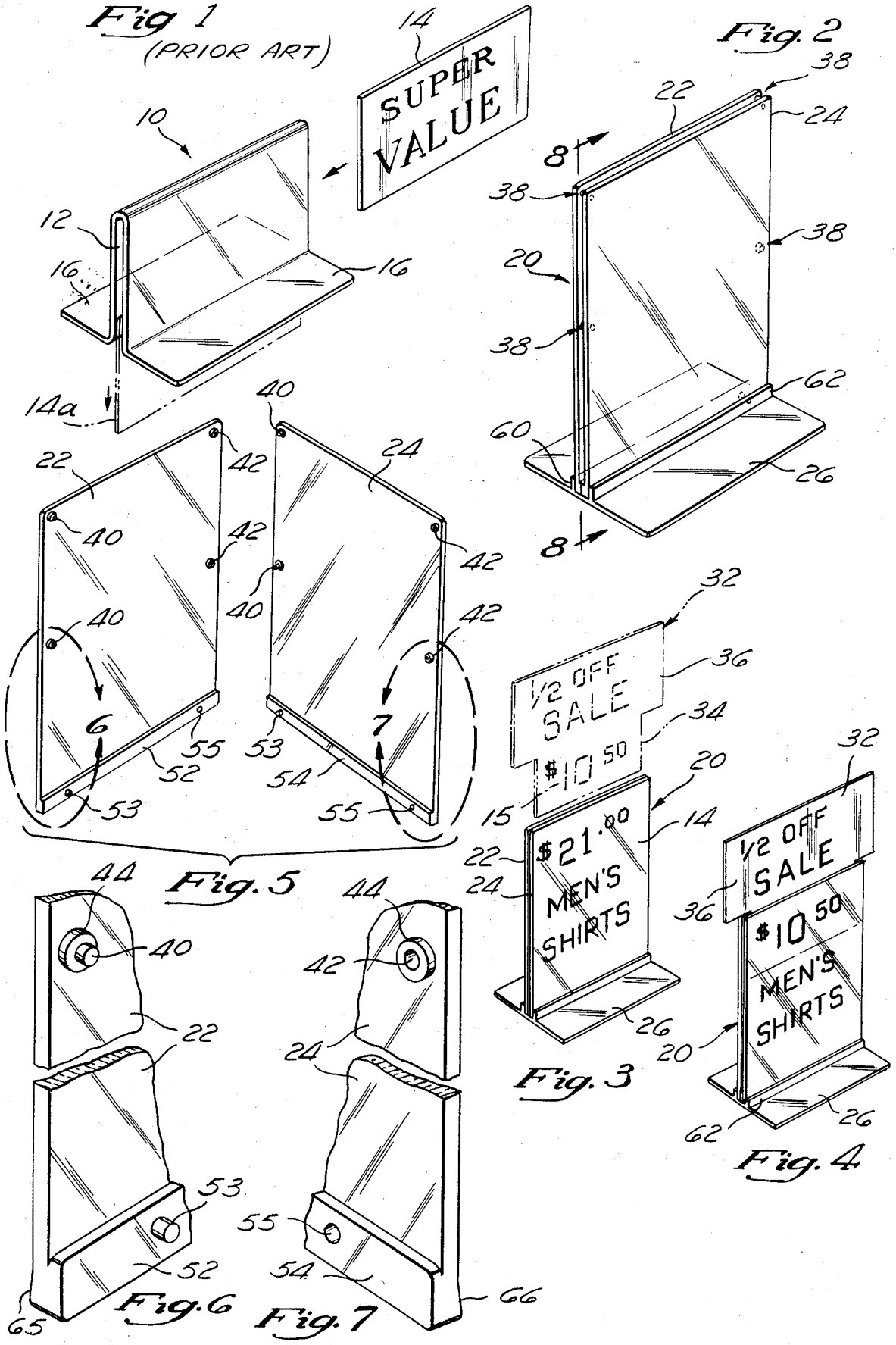
Fig 1 (PRIOR ART)
FIG. 1 is a perspective view of a prior art cardholder.
FIG. 2 is a perspective view showing a first embodiment of a display device according to the present invention.
FIGS. 3 and 4 are perspective views of the present invention illustration showing a display card and a header card respectively placed therein.
FIG. 5 is a perspective view of the transparent plates of the present invention showing the holder support ledges and the positioning of the pin and holes assemblies.
FIGS. 6 and 7 are enlarged fragmentary views taken about line 6 and line 7, respectively, of FIGURES.

Referring to FIG. 1, there is shown an example of typical prior art cardholder comprising a fold-over card display 10. The fold-over display 10 is typically heat-formed from a single sheet of semi-rigid plastic material, by folding the material at the center to form an inverted U-shaped opening 12 into which a card 14 may be placed. The ends of the sheet are folded at outwardly extending right angles to the opening 12 to form support members 16. A card 14 placed in the U-shaped opening 12 is supported by the surface on which the fold-over display 10 rests and often times falls from the fold-over display 10 when not in contact with the support surface, as shown by the arrow and phantom display card 14a in FIG. 1. Because of the nature of the heat-folding procedure, the separation of the two inside surfaces of the U-shaped opening 12 typically varies from top to bottom, thereby often making card insertion and removal difficult.

Referring to FIG. 2, there is shown the improved display device 20 of the present invention comprised generally of a pair of flat transparent plates 22 and 24 which are detachably mounted to a base member 26. As illustrated in FIG. 3, cards 14 that are to be displayed in the device 20 are inserted in the top of the device 20 between the transparent plates 22 and 24.

The plates 22 and 24 are preferably formed by an injected mold process using high-impact polycarbonate material, although other plastic and nonplastic materials are within the contemplation of the invention. As can be seen in FIGS. 5 through 7, the plates 22 and 24 are formd with strategically placed snap-fit assemblies 38 comprised of a plurality of pins 40 extending from the surface of one plate 22 and a corresponding plurality of aligned apertures or holes 42 in the opposing plate 24. The pins 40 and apertures 42 are sized to provide a slight snap or press fit when the pins 40 are inserted within the apertures 42.

In addition to providing for the alignment of the plates 22 and 24 during assembly, the snap-fit assemblies 38 securely hold the plates 22 and 24 together while permitting easy detachment for cleaning the inside surface or for replacing a damaged plate 22 and 24. Also, in certain instances, additional snap-fit assemblies 38 may be placed along the sides of the plate 22 and 24 to restrict the lateral movement of the card 14 within the plates 22 and 24. In addition, it is often desirable to place information in the device 20, in addition to the card 14, in the form of a header card 32. Special header cards 32 are designed having an extension 34 sized to be inserted in the top of the display device 20. The length of the informational portion 36 of the header 32 is sized so as to exceed the width of the plates 22 and 24. Header cards 32 may be placed in the display device 20 without disturbing or obscuring information on the card 14 by placing the extension behind the card 14. The extension 34 may also be used to convey information 15 positioned in front of the card 14 to selectively alter certain information, as illustrated by the price changing in FIG. 3 and FIG. 4.

Referring to FIGS. 5, 6, and 7, the snap-fit assemblies 38 include an annular boss structure 44 surrounding both the pins 40 and apertures 42 that extend outwardly from the surface of the plates 22 and 24 a predetermined distance. Upon assembly of the plates 22 and 24 as shown in FIG. 5, with the pins 40 having been received within their corresponding apertures 42, the annular bosses 44 directly abut one another thereby assuring that a constant distance separates the plates 22 and 24 facilitating the easy insertion and removal of cards 14 within the display device 20.

The number of snap-fit assemblies 38 used varies with the size of the plates 22 and 24. In the preferred embodiment, a snap-fit assembly 38 is placed at least at or near each corner of the plates 22 and 24. The assemblies 38 located in the upper corner of the plates 22 and 24 form an auxiliary support surface 50 which serves to support the informational portion 36 of the header card 32.

Support ledges 52 and 54 are formed adjacent the bottom edge of the inside surface of each of the plates 22 and 24 as can be seen in FIGS. 6 and 7. The combined width of the ledges 52 and 54 when the plates 22 and 24 are assembled is substantially equal to the combined width of the abutted annular bosses 44. The ledges 52 and 54 become contiguous upon assembly of the plates 22 and 24 and form a support surface 56 which serves to support the card 14 when positioned between the plates 22 and 24. Plural pin and hole assemblies 53 and 55. Plural pin and hole assemblies 53 and 55 are also formed on the ledges 52 and 54, to serve as snap together means for the ledges 52 and 54.

The base structure 26, in the preferred embodiment, comprises a base plate 58 having two elongate members 60 and 62 extending outwardly and perpendicular to the base plate 58 and to an elongate channel 64 sized to receive the lower portion of the assembled plates 22 and 24. As can be seen in FIG. 8, the lower portion of the channel 64 adjacent the base plate 58 is formed in a trapezoidal configuration, complimentary to the cross-sectional configuration of the bottom of the plates 22 and 24 which each include an angularly extending flange 65 and 66 respectively. Assembly of the plates 22 and 24 and the base structure 26 is accomplished by moderately manually flexing or deforming the base structure 26 in a generally concave manner, as illustrated by the arrows in FIG. 8, which causes the width of the channel 64 to increase. Once the bottom edge of the plates 22 and 24 are placed or entered into the channel 64, releasing the flexing force causes the channel 64 to extend over and tightly engage the flanges 65 and 66 of the plates 22 and 24.

Referring to FIGS. 9 and 10, there is shown a second embodiment of a base structure 100 comprised of a channel member 112, a base plate 114 and a cylindrical post 116 extending between and permanently affixed to the channel member 112 and the base plate 114. The base plate 114 includes a rectangular portion 118 and a pair of legs 120 and 122 extending therefrom in a plane perpendicular to the plane of the rectangular portion 118 to form a slot or channel 124. The slot 124 is dimensioned to fit securely upon a first upright member 68 of a display structure to support the card display device 20 thereon. A notch 126 may be formed in the legs 120 and 122 sized to receive a second upright member 70 such that the base structure may be positioned upon the intersection of two perpendicularly oriented upright members 78 and 70. The channel member 112 has a generally U-shaped cross-section sized to tightly receive the bottom of the assembled plates 22 and 24.

An insert 128 is formed of a flexbile material and sized to be disposed within the slot 124 of the base plate 114 and serves to protect the upright members 68 and 70 from being damaged or marred by the base plate 114 during use. The insert 128 is formed having lips 130 and 132 at either end extending therefrom such that when the insert 128 is in place in the slot 124, the lips 130 and 132 restrict axial movement of the insert 128 in the slot 124. U-shaped extensions 134 and 136 are also formed on the insert 128 sized to engage the bottom edge of the legs 120 and 122 of the base plate 115 to assist in holding the insert 128 in place in the slot 124.

In summary, the present invention comprises an improved display device 20 having a pair of uniformly spaced transparent plates 22 and 24 which provide for easy insertion and removal of cards 14 and which has an inside ledge 56 for support of the cards 14. The plates 22 and 24 can be easily detachably mounted to a variety of bases that may be designed for specific applications. It should be appreciated that the described embodiments of the base structures 24 and 110 are by way of example, and a variety of different bases may be used with the plates 22 and 24. Further, the dimensions of the plates 22 and 24 may be varied to accommodate specific size cards 14. Thus, many other designs as well as construction materials can be readily devised in accordance with the described principles by those skilled in the art without departing from the spirit of the invention.

What is claimed is:

1. An improved device for displaying a card comprising:

a pair of plate members to be demountably fastened together to hold a card, said plate members being juxtaposed and spaced from one another by a distance sufficient to allow a card to be inserted from above the top edge of said plate members while said plate members are fastened together to reside between said plate members;

a ledge formed on the inside surfaces of said plate members adjacent their bottom edge for supporting said card between said plate members;

a base member adapted to detachably mount to said plate members;

plural pin and aperture assemblies located about the inside periphery of said plate members for detachably securing said plate members together in a juxtaposed orientation, each of said pin and aperture assemblies being comprised of a cylindrically-shaped pin extending outward from one said plate member and a complimentary hole formed in the other said plate member sized to engageably receive said pin, said plural pin and aperture assemblies being positioned adjacent each of the corners of said plate members, a pair of said plural pin and aperture assemblies being located adjacent the top edge of said plate members positioned to provide an auxiliary support surface adapted to receive a header card while said plate members are connected together and to support the header card placed between said plate members.

2. The device of claim 1 wherein said plate members are formed of a transparent material adapted to provide double-sided viewing of the card disposed between said plate members.

3. The device of claim 2 further comprising a flanged registry surface formed adjacent the bottom edge of each of said plate members.

4. The device of claim 3 wherein said base member includes an elongate channel to receive said flanged registry surface.

5. An improved device for displaying a card comprising:

a pair of plate members to be demountably fastened together to hold a card, said plate members being juxtaposed and spaced from one another by a distance sufficient to allow a card to be inserted from above the top edge of said plate members while said plate members are fastened together to reside between said plate members;

a ledge formed on the inside surfaces of said plate members adjacent their bottom edge for supporting said card between said plate members;

a base member adapted to detachably mount to said plate members; and support means adjacent the top edge of said plate members for supporting a header card having an informational portion above the top edge of said plate members and an extension which projects between said plate members.

6. The device of claim 5 wherein said support means includes a pair of bosses extending from one of said plate members toward the other of said plate members when said plate members are fastened together, the extension portion extending between the pair of bosses a distance sufficient to permit the lower edge of the informational portion of said header card to rest on said bosses.

7. The device of claim 6 wherein both of said plate members include a pair of bosses for supporting the header card, one pair of bosses including connecting pins extending therefrom, the other pair of bosses including passages for receiving the connecting pins therein in a snap fitting relation.

* * * * *